US012503272B2

(12) United States Patent
Bevier

(10) Patent No.: US 12,503,272 B2
(45) Date of Patent: Dec. 23, 2025

(54) CONTAINER FOR REPEATED USES

(71) Applicant: INTERNATIONAL PAPER COMPANY, Memphis, TN (US)

(72) Inventor: Alex Dean Bevier, Fresno, CA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 548 days.

(21) Appl. No.: 17/691,866

(22) Filed: Mar. 10, 2022

(65) Prior Publication Data

US 2023/0286694 A1 Sep. 14, 2023

(51) Int. Cl.
*B65D 5/66* (2006.01)
*B65D 5/36* (2006.01)

(52) U.S. Cl.
CPC ..... *B65D 5/6608* (2013.01); *B65D 5/3621* (2013.01)

(58) Field of Classification Search
CPC ..... B65D 5/6608; B65D 5/3621; B65D 5/10; B65D 5/103; B65D 5/4266; B65D 5/0227; B65D 5/0263; B65D 5/061
USPC ..... 229/100, 117, 185, 117.01; 206/167, 206/45.29
See application file for complete search history.

(56) References Cited

U.S. PATENT DOCUMENTS 2,327,709 A * 8/1943 Himes ..... B65D 5/3621 229/117
2,388,190 A 10/1945 Smart
2,554,677 A * 5/1951 Michetti ..... B65D 5/10 229/117
2,918,205 A 12/1959 Zeitter
3,057,535 A 10/1962 Thompson
3,960,313 A * 6/1976 Sax ..... B65D 5/3621 229/117
4,007,869 A 2/1977 Stolkin et al.
4,142,666 A 3/1979 Rosenbaum, II
5,664,726 A * 9/1997 Opper ..... B65D 5/10 229/185
5,755,377 A * 5/1998 Durand ..... B65D 5/10 229/110

(Continued)

FOREIGN PATENT DOCUMENTS

GB 453092 A 9/1936

*Primary Examiner* — Christopher R Demeree
(74) *Attorney, Agent, or Firm* — Robert L. Showalter; Thomas W. Ryan; Clifford R. Lamar, II

(57) ABSTRACT

A container is provided comprising: first and second side panels, a front panel, a back panel, first and second minor flaps, and first and second major flaps. The first minor flap may be coupled to the first side panel along a lateral edge of the first side panel, and the second minor flap may be coupled to the second side panel along a lateral edge of the second side panel. The first major flap may be coupled to the front panel along a lateral edge of the front panel, and the second major flap coupled to the back panel along a lateral edge of the back panel. The first major flap may comprise a first locking tab capable of engaging with the second major flap when the container is erected and the second major flap may comprise a second locking tab capable of engaging with the first major flap when the container is erected. The first and second minor flaps and the first and second major flaps may be folded inwardly along corresponding fold lines such that the first and second minor flaps are located inwardly from the first and second major flaps.

6 Claims, 9 Drawing Sheets

(56) References Cited

U.S. PATENT DOCUMENTS

| | | | | |
|---|---|---|---|---|
| 5,927,593 | A * | 7/1999 | Berkowitz | B65D 5/0281 229/117 |
| 6,349,876 | B1 | 2/2002 | Dowd | |
| 6,364,200 | B1 | 4/2002 | Moss et al. | |
| 6,386,437 | B1 | 5/2002 | Larson, Jr. | |
| 6,409,077 | B1 * | 6/2002 | Telesca | B65D 5/52 229/164 |
| 6,637,645 | B2 * | 10/2003 | Ferguson | B65D 77/02 229/117 |
| 6,705,515 | B2 | 3/2004 | Dowd | |
| 6,926,192 | B1 * | 8/2005 | Dowd | B65D 5/445 229/148 |
| 7,392,904 | B1 * | 7/2008 | Jackson | B65D 25/24 229/185 |
| 7,731,080 | B2 | 6/2010 | Zacher et al. | |
| 7,841,511 | B2 * | 11/2010 | Fogle | B65D 5/0281 229/185 |
| 7,886,958 | B2 | 2/2011 | Smith | |
| 8,608,050 | B2 | 12/2013 | Seliger et al. | |
| 8,931,686 | B2 * | 1/2015 | Brundage | B31B 50/26 229/185 |
| 8,939,350 | B2 | 1/2015 | Valencia | |
| 10,336,501 | B2 | 7/2019 | Smith | |
| 2005/0006446 | A1 | 1/2005 | Stafford | |
| 2010/0065620 | A1 | 3/2010 | Smith | |

* cited by examiner

CONTAINER FOR REPEATED USES

FIELD OF THE DISCLOSURE

This invention relates generally to packaging and, more particularly, to a container or box, which is designed for repeated uses.

BACKGROUND

Containers fabricated from paperboard, e.g., corrugated fiberboard or corrugated paperboard, are often used to store and transport goods. Such containers may be formed from a blank of sheet material (hereinafter "blank"), which is folded and glued. One such container is disclosed in U.S. Pat. No. 2,918,205 and comprises an interlocking bottom closure structure.

SUMMARY

In accordance with a first aspect, a container is provided comprising: first and second side panels, a front panel, a back panel, first and second minor flaps, and first and second major flaps. The first minor flap may be coupled to the first side panel along a lateral edge of the first side panel, and the second minor flap may be coupled to the second side panel along a lateral edge of the second side panel. The first major flap may be coupled to the front panel along a lateral edge of the front panel, and the second major flap may be coupled to the back panel along a lateral edge of the back panel. The first major flap may comprise a first locking tab capable of engaging with the second major flap when the container is erected and the second major flap may comprise a second locking tab capable of engaging with the first major flap when the container is erected. The first and second minor flaps and the first and second major flaps may be folded inwardly along corresponding fold lines such that the first and second minor flaps are located inwardly from the first and second major flaps. The container, after initially being erected, may be capable of being collapsed and re-erected.

The first major flap may comprise a first main section and a first end section. The first main section may define a first outer angled edge and the first end section may define a first inner angled edge. The second major flap may comprise a second main section and a second end section. The second main section may define a second outer angled edge and the second end section may define a second inner angled edge. When the container is fully erected, the first outer angled edge may align with the second inner angled edge and the second outer angled edge may align with the first inner angled edge.

A first fold line may extend between the first main section and the first end section and a second fold line may extend between the second main section and the second end section.

The first major flap may be joined to the first minor flap only at the first end section of the first major flap and the second major flap may be joined to the second minor flap only at the second end section of the second major flap.

No portion of the second major flap is interposed between the first end section and the first minor flap.

The first outer angled edge may extend at an angle between 35 degrees and 55 degrees to the lateral edge of the front panel and the second outer angled edge may extend at an angle between 35 degrees and 55 degrees to the lateral edge of the back panel.

The first outer angled edge may be generally parallel to the first inner angled edge and the second outer angled edge may be generally parallel to the second inner angled edge.

The first end section may define a first end section outer angled edge that extends at an angle between 50 degrees to 90 degrees to the lateral edge of the front panel and the second end section may define a second end section outer angled edge that extends at an angle of between 50 degrees and 90 degrees to the lateral edge of the back panel.

The first main section of the first major flap may further comprise a first intermediate edge, a first step and a first angled tab edge. The first intermediate edge may extend between the first inner angled edge of the first end section and the first step. The first step, the first angled tab edge and a portion of the first outer angled edge of the first main section may define the first locking tab.

The second main section of the second major flap may further comprise a second intermediate edge, a second step and a second angled tab edge. The second intermediate edge may extend between the second inner angled edge of the second end section and the second step. The second step, the second angled tab edge and a portion of the second outer angled edge of the second main section may define the second locking tab.

The first minor flap may comprise first and second lateral edges and first and second longitudinal edges. The first minor flap may be coupled to the first side panel at the first lateral edge of the first minor flap. The second lateral edge may have a length less than a length of the first lateral edge. The second longitudinal edge may extend inwardly towards the first longitudinal edge as it extends from the first lateral edge to the second lateral edge.

The second minor flap may comprise third and fourth lateral edges and third and fourth longitudinal edges. The second minor flap may be coupled to the second side panel at the third lateral edge of the second minor flap. The fourth lateral edge may have a length less than a length of the third lateral edge. The fourth longitudinal edge may extend inwardly toward the third longitudinal edge as it extends from the third lateral edge to the fourth lateral edge.

The second longitudinal edge of the first minor flap may extend inwardly to an extent to prevent the first minor flap from engaging with the front panel to prevent the container from collapsing.

The first side panel may be hingedly connected to a longitudinal edge of the front panel at a first interface and hingedly connected to a longitudinal edge of the back panel at a second interface. The second side panel may be hingedly connected to another longitudinal edge of the front panel at a third interface and hingedly connected to another longitudinal edge of the back panel at a fourth interface. When the container is collapsed, the second and third interfaces may be positioned intermediate the first and fourth interfaces.

In accordance with a second aspect, a blank is provided for constructing a container comprising: a front panel having opposing lateral edges and opposing longitudinal edges; a back panel having opposing lateral edges and opposing longitudinal edges; a first side panel having opposing lateral edges and opposing longitudinal edges and hingedly connected to one of the longitudinal edges of the front panel; a second side panel having opposing lateral edges and opposing longitudinal edges and hingedly connected to another one of the longitudinal edges of the front panel; and first and second minor flaps. The first minor flap may be coupled to the first side panel along one of the lateral edges of the first side panel, and the second minor flap may be coupled to the second side panel along one of the lateral edges of the second side panel. The blank may further comprise first and second major flaps. The first major flap may be coupled to the front panel along one of the lateral edges of the front panel, and the second major flap may be coupled to the back panel along one of the lateral edges of the back panel. The first major flap may comprise a first locking tab and the second major flap may comprise a second locking tab. The first major flap may comprise a first outer angled edge extending at an angle between 35 degrees and 55 degrees to the one lateral edge of the front panel, and the second major flap may comprise a second outer angled edge extending at an angle between 35 degrees and 55 degrees to the one lateral edge of the back panel.

The first major flap may comprise a first main section and a first end section. The first main section may comprise the first outer angled edge and the first end section may define a first inner angled edge. The second major flap may comprise a second main section and a second end section. The second main section may comprise the second outer angled edge and the second end section may define a second inner angled edge.

A first fold line may extend between the first main section and the first end section and a second fold line may extend between the second main section and the second end section.

The first outer angled edge may be generally parallel to the first inner angled edge and the second outer angled edge may be generally parallel to the second inner angled edge.

The first end section may define a first end section outer angled edge that extends at an angled between 50 degrees to 90 degrees to the lateral edge of the front panel and the second end section may define a second end section outer angled edge that extends at an angle of between 50 degrees and 90 degrees to the lateral edge of the back panel.

The first main section of the first major flap may further comprise a first intermediate edge, a first step and a first angled tab edge. The first intermediate edge may extend between the first inner angled edge of the first end section and the first step. The first step, the first angled tab edge and a portion of the first outer angled edge of the first main section may define the first locking tab.

The second main section of the second major flap may further comprise a second intermediate edge, a second step and a second angled tab edge. The second intermediate edge may extend between the second inner angled edge of the second end section and the second step. The second step, the second angled tab edge and a portion of the second outer angled edge of the second main section may define the second locking tab.

The first minor flap may comprise first and second lateral edges and first and second longitudinal edges. The first minor flap may be coupled to the first side panel at the first lateral edge of the first minor flap. The second lateral edge may have a length less than a length of the first lateral edge. The second longitudinal edge may extend inwardly towards the first longitudinal edge as it extends from the first lateral edge to the second lateral edge.

The second minor flap may comprise third and fourth lateral edges and third and fourth longitudinal edges. The second minor flap may be coupled to the second side panel at the third lateral edge of the second minor flap. The fourth lateral edge may have a length less than a length of the third lateral edge. The fourth longitudinal edge may extend inwardly toward the third longitudinal edge as it extends from the third lateral edge to the fourth lateral edge.

BRIEF DESCRIPTION OF THE DRAWINGS

While the specification concludes with claims particularly pointing out and distinctly claiming the subject matter of the present disclosure, it is believed that the subject matter will be better understood from the following description in conjunction with the accompanying Drawing Figures, in which like reference numerals identify like elements, and wherein:

DETAILED DESCRIPTION

In the following detailed description of the preferred embodiments, reference is made to the accompanying drawings that form a part hereof, and in which is shown by way of illustration, and not by way of limitation, specific preferred embodiments in which the subject matter of this disclosure may be practiced. It is to be understood that other embodiments may be utilized and that changes may be made without departing from the spirit and scope of the present disclosure.

Figure 1:
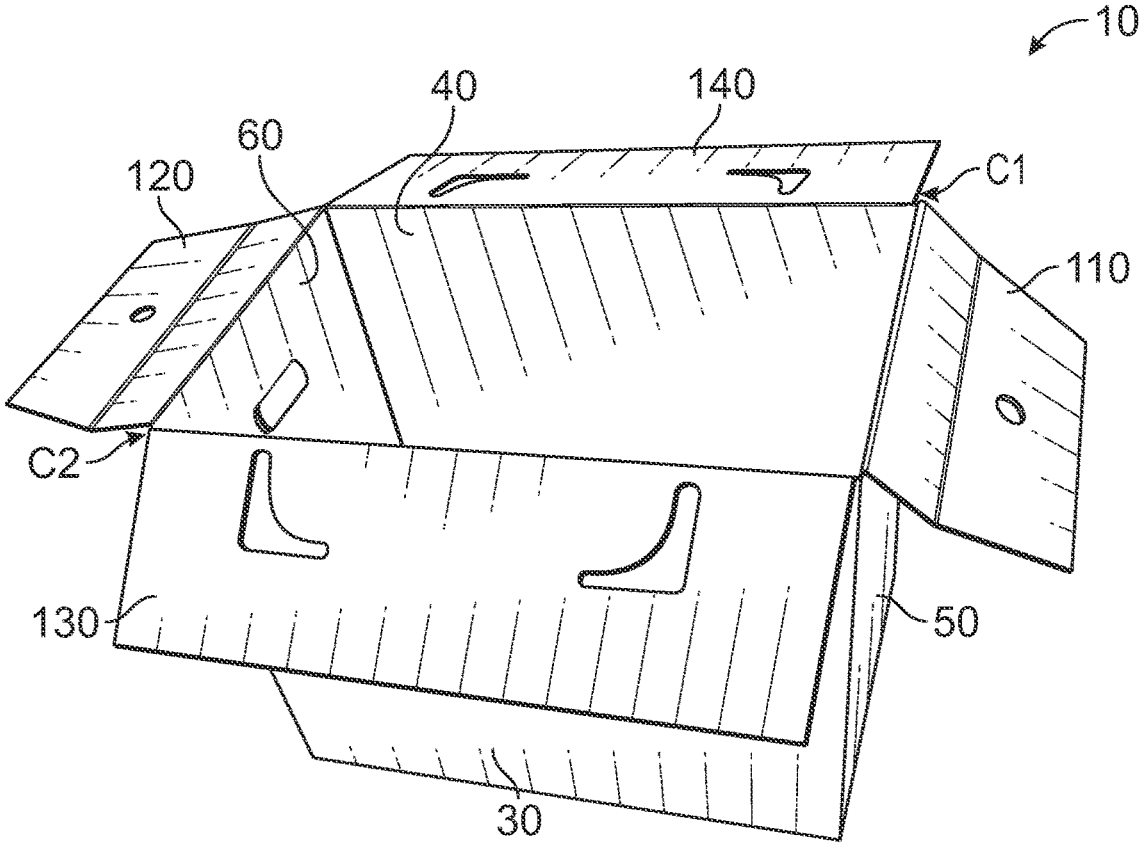
FIG. 1 is a perspective view of a formed box with top minor and major flaps open to allow the box to receive product.
Figure 2:
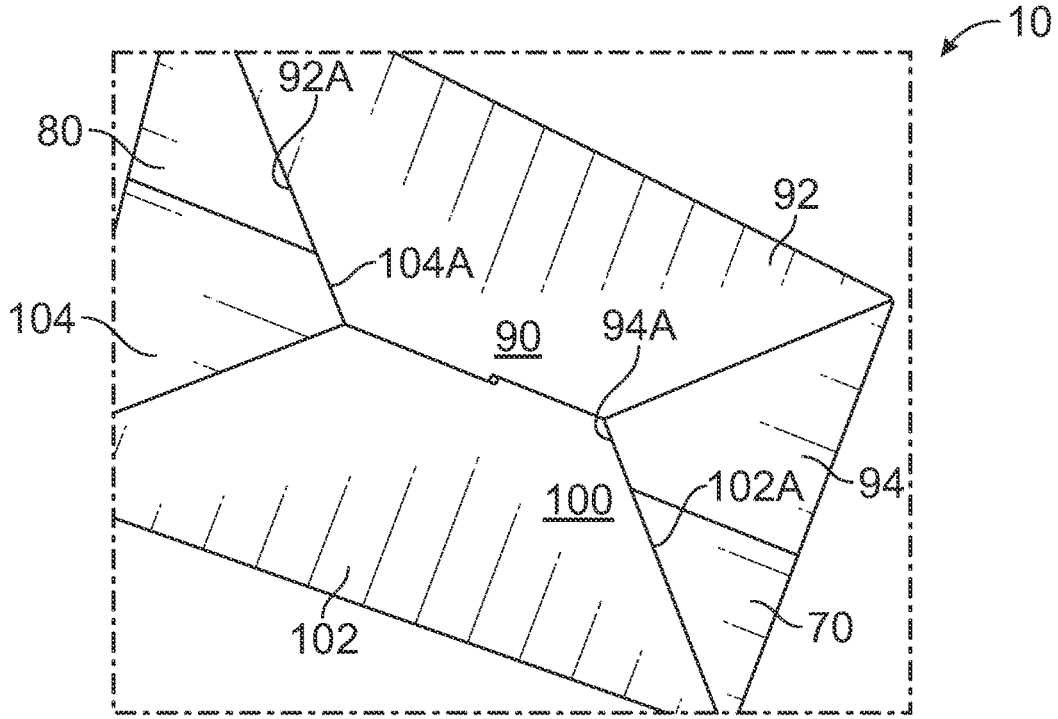
FIG. 2 is a perspective view of a portion of the bottom of the box in FIG. 1.
Figure 3:
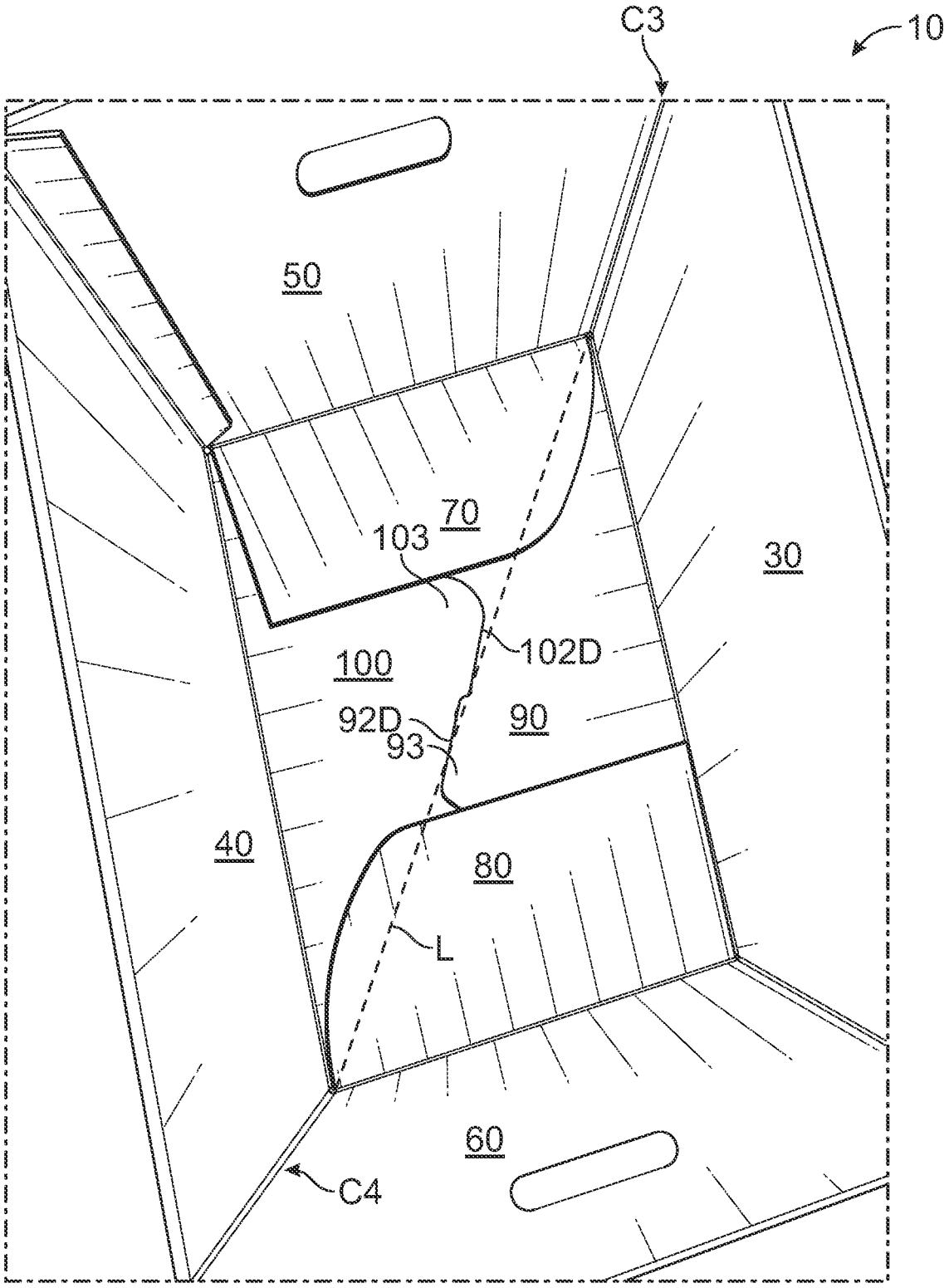
FIG. 3 is a perspective view of the interior of the box of FIG. 1.
Figure 4:
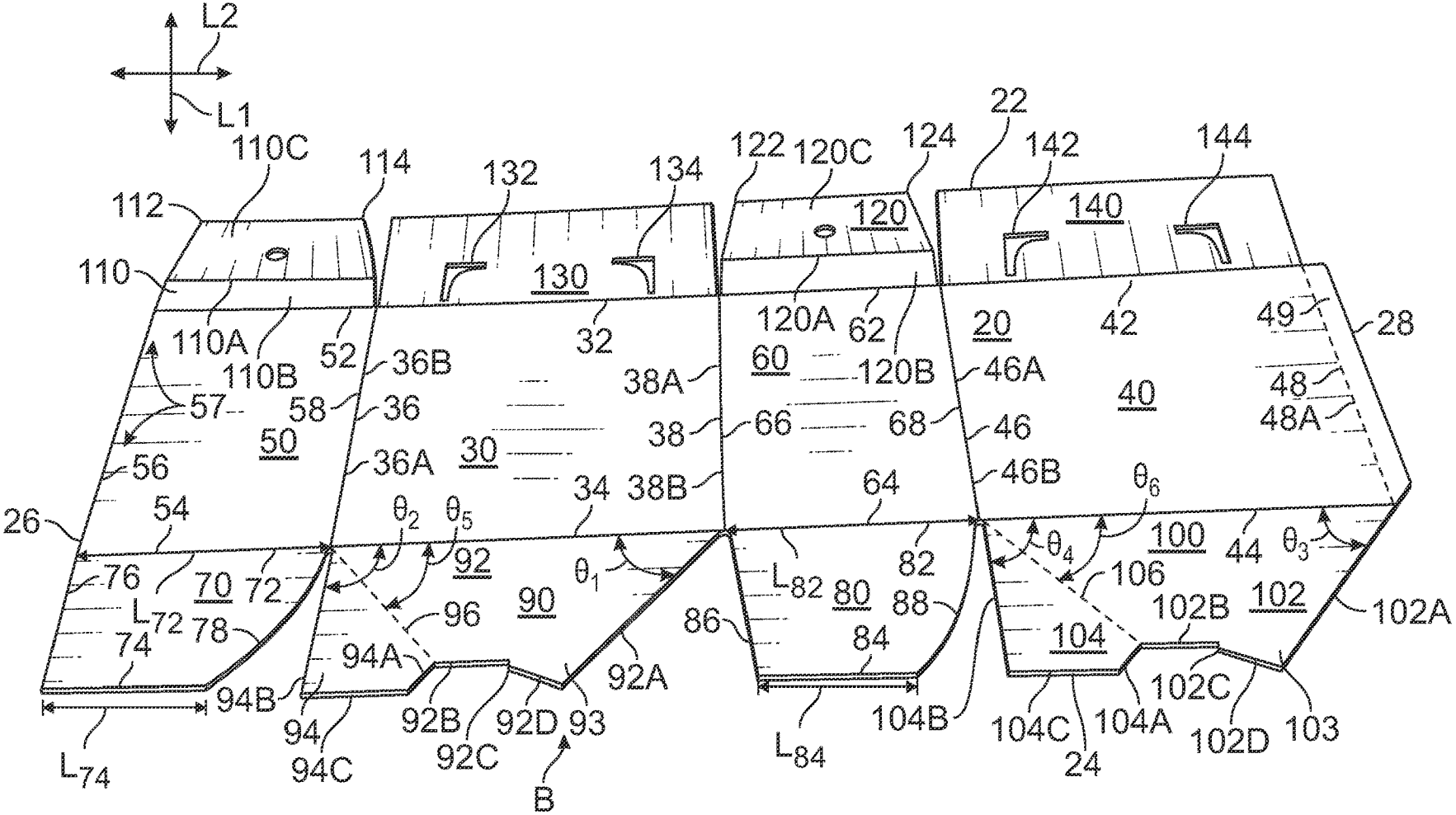
FIG. 4 is a view of a blank from which the box of FIG. 1 is formed.

Referring to FIGS. 1-3, a container or box 10 is illustrated, which is adapted to be formed from a blank B, see FIG. 4. As will be discussed further below, a glue flap of the blank B may be joined or fixed to a first side panel in a manufacturing facility via glue, tape or staples to form a preformed container, which is collapsible in a generally flat condition for shipping to a customer. Once received by a customer, the preformed container may be further formed or erected and further glued, taped or stapled, such that it has a collapsible, closed bottom formed from bottom flaps, two of which may interlock with one another. Once the preformed container has been erected and further glued, taped or stapled, it is in the form of the container 10 illustrated in FIG. 1, with upper or top flaps open to allow product (not shown) to be placed in the box 10. After product has been placed in the box 10, the upper flaps may be closed as discussed further below. The closed box, with product, may be shipped to another location, and opened so as to allow the product to be removed from the box 10. The box 10 may then be collapsed for later reuse. When the box 10 is collapsed, the bottom flaps, including the pair of interlocking flaps, fold within the box 10. The box 10 may be reused multiple times.

The blank B may be formed from paperboard, e.g., corrugated fiberboard or corrugated paperboard, and may be die cut to the shape shown in FIG. 4, although other materials and variations of the illustrated shape may be provided within the scope of the container described and claimed herein. The blank B illustrated in FIG. 4 is a planar piece of material in which the inner side 20 is shown facing out of the page. The blank B extends in a lateral direction $L_1$ between first and second lateral ends 22 and 24 and further extends in a longitudinal direction $L_2$ between first and second outer longitudinal ends 26 and 28.

The blank B may further comprise a front panel 30 having opposing lateral edges 32 and 34, respectively, and opposing longitudinal edges 36 and 38, respectively, and a back panel 40 having opposing lateral edges 42 and 44, respectively, and opposing longitudinal edges 46 and 48, respectively. A first side panel 50 having opposing lateral edges 52 and 54, respectively, and opposing longitudinal edges 56 and 58, respectively, may be hingedly connected to the longitudinal edge 36 of the front panel 30 at a fold line 36A. A second side panel 60 having opposing lateral edges 62 and 64, respectively, and opposing longitudinal edges 66 and 68, respectively, may be hingedly connected to the longitudinal edge 38 of the front panel 30 at a fold line 38A and to the longitudinal edge 46 of the back panel 40 at a fold line 46A. A glue flap 49 is coupled to the longitudinal edge 48 of the back panel 40.

A bottom first minor flap 70 is hingedly coupled to the first side panel 50 along the lateral edge 54 of the first side panel 50 at a fold line and a bottom second minor panel 80 is hingedly coupled to the second side panel 60 along the lateral edge 64 of the second side panel 60 at a fold line. A bottom first major flap 90 is hingedly coupled to the front panel 30 along the lateral edge 34 of the front panel 30 at a fold line and a bottom second major flap 100 is hingedly coupled to the back panel 40 along the lateral edge 44 of the back panel 40 at a fold line.

The bottom first major flap 90 comprises a first main section 92 and a first end section 94. A first fold line 96 extends between the first main section 92 and the first end section 94 and may have an angle $\Theta_5$ between 43 degrees and 47 degrees and preferably 45 degrees to the lateral edge 34 of the front panel 30. The first main section 92 comprises a first outer angled edge 92A extending from at or near the lateral edge 34 of the front panel 30 to a first angled tab edge 92D. The first outer angled edge 92A extends at an angle $\Theta_1$ between 35 degrees and 55 degrees to the lateral edge 34 of the front panel 30. The first main section 92 further comprises a first intermediate edge 92B, a first step 92C, and the first angled tab edge 92D. The first intermediate edge 92B extends between a first inner angled edge 94A of the first end section 94 and the first step 92C of the first main section 92. The first step 92C, the first angled tab edge 94D and a portion of the first outer angled edge 92A of the first main section 92 defines a first locking tab 93. As can be seen from FIG. 4, the first outer angled edge 92A of the first main section 92 is generally parallel to the first inner angled edge 94A of the first end section 94.

The first end section 94 further comprises a first end section outer angled edge 94B that extends at an angle $\Theta_2$ between 50 degrees to 90 degrees to the lateral edge 34 of the front panel 30, see FIG. 4. A first end section intermediate edge 94C extends between the first inner angled edge 94A of the first end section 94 and the first end section outer angled edge 94B.

The first minor flap 70 comprises first and second lateral edges 72 and 74, respectively, and first and second longitudinal edges 76 and 78, respectively. The first minor flap 70 is coupled to the first side panel 50 at the first lateral edge 72 of the first minor flap 70. The second lateral edge 74 has a length $L_{74}$ less than a length $L_{72}$ of the first lateral edge 72. It is preferred that the length $L_{74}$ of the second lateral edge 74 be as large as possible so as to provide added strength to the erected container 10, yet not be so large as to cause the second longitudinal edge 78 to engage and jam with the front panel 40 when the box 10 is being erected. The second longitudinal edge 78 extends inwardly towards the first longitudinal edge 76 as it extends from the first lateral edge 72 to the second lateral edge 74. In the illustrated embodiment, the second longitudinal edge 78 has a curved or arc shape, but could have any other shape, such as a linear shape. If the second longitudinal edge 78 had a linear shape, it would be angled inwardly toward the first longitudinal edge 76 and have an angle of from 50 degrees to 80 degrees relative to lateral edge 72.

The bottom second major flap 100 comprises a second main section 102 and a second end section 104. A second fold line 106 extends between the second main section 102 and the second end section 104 and may have an angle $\Theta_6$ between 43 degrees and 47 degrees and preferably 45 degrees to the lateral edge 44 of the back panel 40. The second main section 102 comprises a second outer angled edge 102A extending from at or near the lateral edge 44 of the back panel 40 to a second angled tab edge 102D. The second outer angled edge 102A extends at an angle $\Theta_3$ between 35 degrees and 55 degrees to the lateral edge 44 of the back panel 40. The second main section 102 further comprises a second intermediate edge 102B, a second step 102C, and the second angled tab edge 102D. The second intermediate edge 102B extends between a second inner angled edge 104A of the second end section 104 and the second step 102C of the second main section 102. The second step 102C, the second angled tab edge 104D and a portion of the second outer angled edge 102A of the second main section 102 define a second locking tab 103. As can be seen from FIG. 4, the second outer angled edge 102A of the second main section 102 is generally parallel to the second inner angled edge 104A of the second end section 104.

The second end section 104 further comprises a second end section outer angled edge 104B that extends at an angle $\Theta_4$ between 50 degrees to 90 degrees to the lateral edge 44 of the back panel 40. A second end section intermediate edge 104C extends between the second inner angled edge 104A of the second end section 104 and the second end section outer angled edge 104B.

The second minor flap 80 comprises first and second lateral edges 82 and 84, respectively, and first and second longitudinal edges 86 and 88, respectively. The second minor flap 80 is coupled to the second side panel 60 at the first lateral edge 82 of the second minor flap 80. The second lateral edge 84 has a length $L_{84}$ less than a length $L_{82}$ of the first lateral edge 82. It is preferred that the length $L_{84}$ of the second lateral edge 84 be as large as possible so as to provide added strength to the erected container 10, yet not so large as to cause the second longitudinal edge 88 to engage and jam with the back panel 40 when the box 10 is being erected. The second longitudinal edge 88 extends inwardly towards the first longitudinal edge 86 as it extends from the first lateral edge 82 to the second lateral edge 84. In the illustrated embodiment, the second longitudinal edge 88 has a curved or arc shape, but could have any other shape, such as a linear shape.

The blank B further comprises top first and second minor flaps 110 and 120, respectively, and top first and second major flaps 130 and 140, respectively. The top first minor flap 110 is hingedly coupled to the first side panel 50 along the lateral edge 52 of the first side panel 50 at a fold line. The top first minor flap 110 comprises a fold line 110A between inner and outer sections 110B and 110C. The outer section 110C of the top first minor flap 110 comprises first and second outer corners 112 and 114, respectively. The top second minor flap 120 is hingedly coupled to the second side panel 60 along the lateral edge 62 of the second side panel 60 at a fold line. The top second minor flap 120 comprises a fold line 120A between inner and outer sections 120B and 120C. The outer section 120C of the top second minor flap 120 comprises third and fourth outer corners 122 and 124, respectively.

The top first major flap 130 is hingedly coupled to the front panel 30 along the lateral edge 32 of the front panel 30 at a fold line. The top first major flap 130 comprises first and second openings 132 and 134, respectively. The top second major flap 140 is hingedly coupled to the back panel 40 along the lateral edge 42 of the back panel 40 at a fold line. The top second major flap 140 comprises third and fourth openings 142 and 144, respectively.

Figure 5:
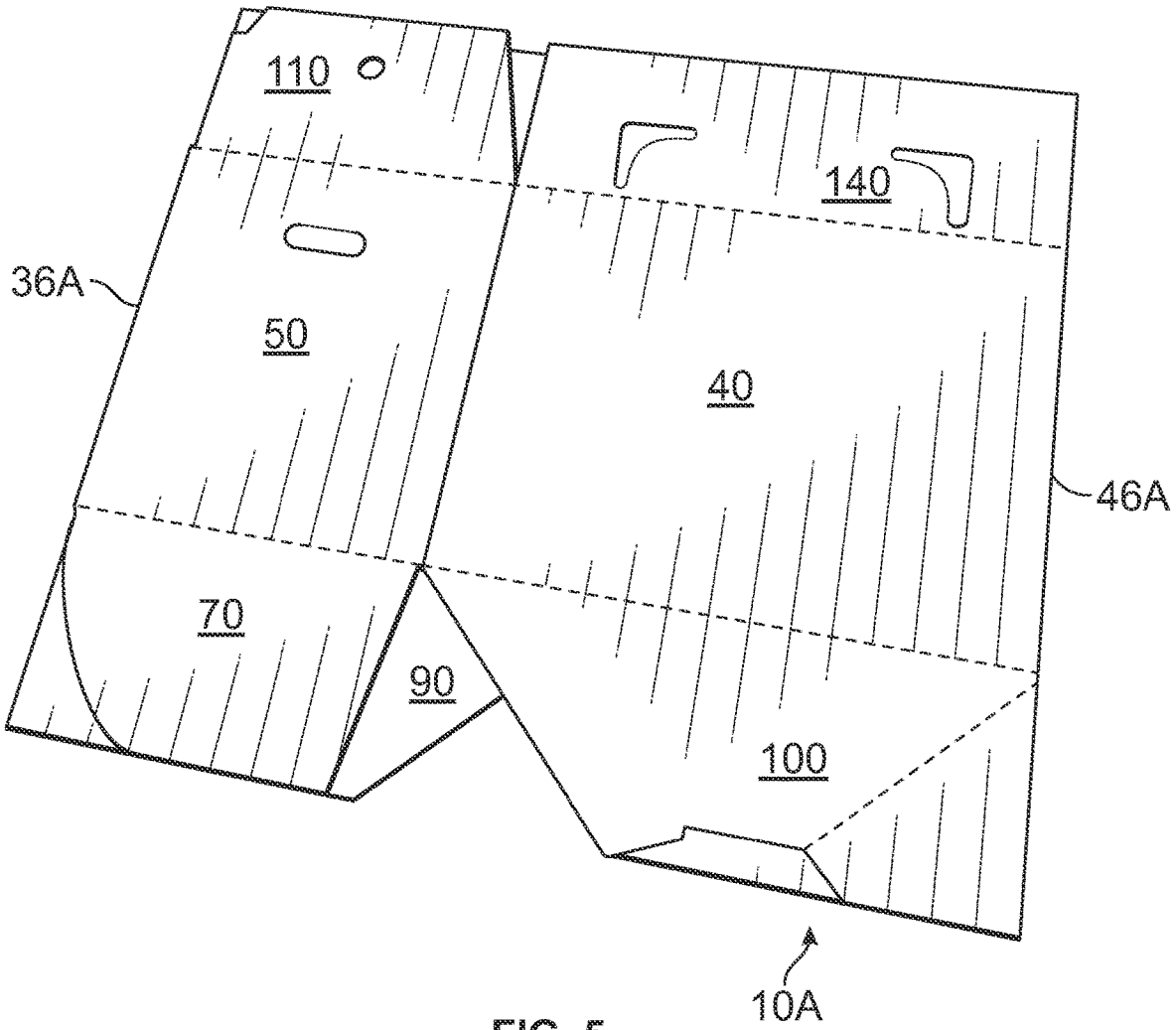
FIG. 5 is a view of a preformed box from the blank of FIG. 4.

The blank B may be preformed at the manufacturer by folding the back panel 40 along the fold line 46A at or near its longitudinal edge 46 so the back panel 40 is positioned over the second side panel 60 and over a portion of the front panel 30, see FIG. 5. Thereafter, the first side panel 50 is folded along the fold line 36A at or near the longitudinal edge 36 of the front panel 30 so as to be positioned over a portion of the front panel 30 and over the glue flap 49. A perimeter portion 57 of the first side panel 50, near its longitudinal edge 56, is coupled to the glue flap 49 on the inner or outer side of the glue flap 49 via adhesive, staples, tape or the like to define a preformed container 10A as illustrated in FIG. 5. The preformed container 10A may be in a collapsed state, i.e., in a generally flat condition, to allow for easy shipment to a customer. As noted above, once the preformed container 10A is received by a customer, it may be further formed or erected and further glued, taped or stapled to receive product.

The steps to further form the preformed container 10A into the container 10 may be performed manually or on a case erector. In the past, very expensive, dedicated folding and gluing equipment was required to fold and glue bottom flaps in a sequence such that each minor flap was positioned between the two major flaps. Hence, the present container or box 10 allows a customer to erect and glue the box 10 without having to invest in expensive folding and gluing equipment. It is also noted that when a preformed container was formed in the past, the minor and major flaps were first folded inwardly about 180 degrees and glued at appropriate locations prior to folding a back panel, then a side panel and then joining a glue flap to the side panel. In the present invention, the minor and major flaps do not need to be folded 180 degrees against the front, back and side panels prior to forming the preformed container. Hence, the preformed container can be further formed on a case erector, which is less expensive than dedicated folding and gluing equipment, where the major and minor flaps are folded inwardly after the preformed container has been expanded to a tube-like shape, i.e., where the front, back and side panels are positioned 90 degrees to one another.

Figure 6:
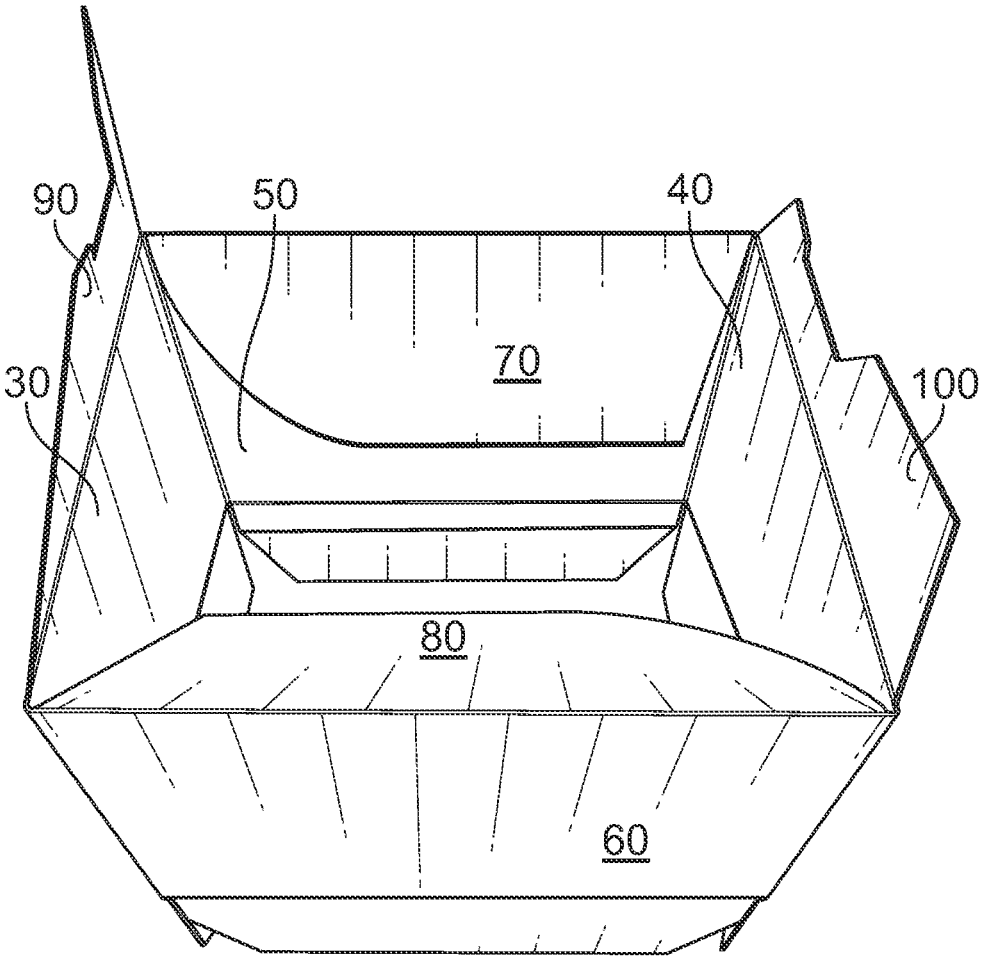
FIGS. 6 and 7 illustrate folding steps to erect the box.

As illustrated in FIG. 6, the preformed container 10A is erected so that first and second side panels 50 and 60 are positioned generally 90 degrees to the front and back panels 30 and 40. Thereafter, the bottom first and second minor flaps 70 and 80 are folded inwardly so that the first minor flap 70 is positioned approximately 90 degrees to its corresponding first side panel 50 and the second minor flap 80 is positioned approximately 90 degrees to its corresponding second side panel 60, see FIG. 6. Hence, both of the first and second minor flaps 70 and 80 are folded prior to folding the first and second major flaps 90 and 100. After the first and second minor flaps 70 and 80 are folded inwardly, the bottom first and second major flaps 90 and 100 are folded inwardly so that the first major flap 90 is positioned approximately 90 degrees to its corresponding front panel 30 and the second major flap 100 is positioned approximately 90 degrees to its corresponding back panel 40, see FIG. 7. During this step, the first locking tab 93 is folded, tucked or positioned underneath the second intermediate edge 102B of the second main section 102 of the bottom second major flap 100 and the second locking tab 103 is folded, tucked or positioned underneath the first intermediate edge 92B of the first main section 92 of the bottom first major flap 90, see FIGS. 2, 3 and 7. When the box 10 is fully erected as illustrated in FIGS. 1-3, the first and second angled tab edges 92D and 102D are generally parallel with one another, see FIG. 3. Because the first and second minor flaps 70 and 80 are folded prior to folding the first and second major flaps 90 and 100, the box 10 can be formed on a case erector.

Figure 7:
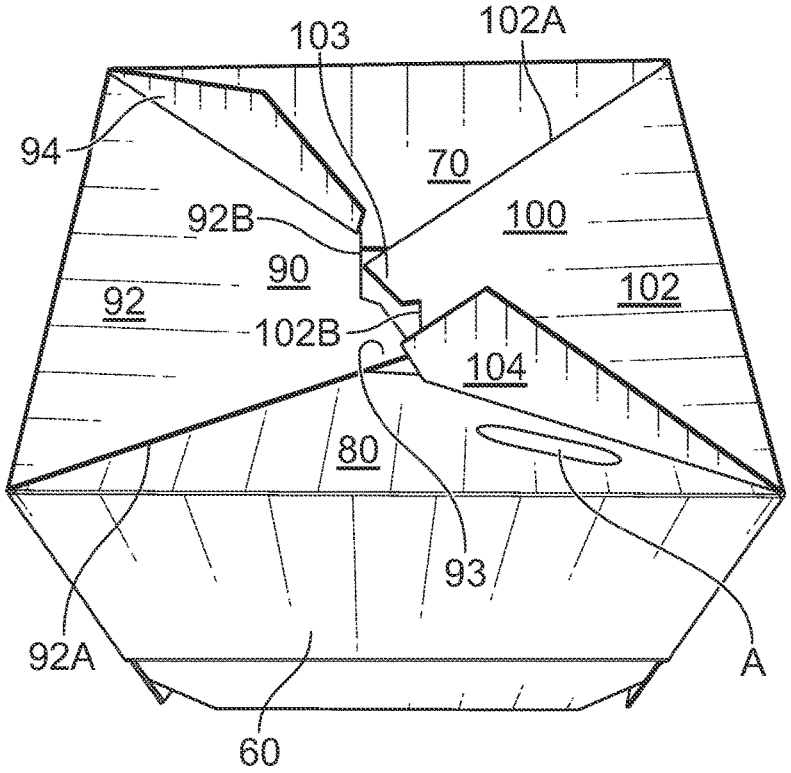

After the bottom first and second major flaps 90 and 100 have been folded and the first and second locking tabs 93, 103 have been folded underneath the second and first intermediate edges 102B and 92B, respectively, the first end section 94 of the bottom first major flap 90 is joined to the bottom first minor flap 70, such as by adhesive (not shown), and the second end section 104 of the bottom second major flap 100 is joined to the bottom second minor flap 80, such as by adhesive A, see FIG. 7. The bottom first major flap 90 is only joined to the first minor flap 70 at the first end section 94. The bottom second major flap 100 is only joined to the second minor flap 80 at the second end section 104.

The shape of the first main section 92 of the bottom first major flap 90 is preferred to be such that the entirety of the second end section 104 of the second major flap 100 is positioned on the second minor flap 80 without having any portion of the main section 92 of the first major flap 90 interposed or positioned between the second end section 104 of the second major flap 100 and the second minor flap 80 to allow a secure bonding to occur between the second end section 104 and the second minor flap 80. Hence, the angle $\Theta_1$ of the first outer angled edge 92A of the first main section 92 of the bottom first major flap 90 is preferred to be of a magnitude, e.g., 35 degrees to 55 degrees, so that no portion of the main section 92 of the first major flap 90 is interposed between the second end section 104 and the second minor flap 80. The shape of the second main section 102 of the bottom second major flap 100 is preferred to be such that the entirety of the second end section 94 of the first major flap 90 is positioned on the first minor flap 70 without having any portion of the main section 102 of the second major flap 100 interposed between the second end section 94 and the first minor flap 70. Hence, the angle $\Theta_3$ the second outer angled edge 102A of the second main section 102 of the bottom second major flap 100 is preferred to be of a magnitude, e.g., 35 degrees to 55 degrees, so that the entirety of the second end section 94 of the first major flap 90 is positioned on and secured to the first minor flap 70 without having any portion of the main section 102 of the second major flap 100 interposed between the second end section 94 and the first minor flap 70.

FIG. 2 is an outside view of the box 10 illustrating the bottom flaps 70, 80, 90 and 100 after the first and second end sections 94 and 104 have been joined to the first and second minor flaps 70 and 80 and the box 10 has been fully erected. As can be seen in FIG. 2, when the container 10 is fully erected, the first outer angled edge 92A of the first main section 92 of the bottom first major flap 90 aligns with, is generally parallel to and may engage the second inner angled edge 104A of the second end section 104 of the bottom second major flap 100 and the second outer angled edge 102A of the second main section 102 of the bottom second major flap 100 aligns with, is generally parallel to and may engage the first inner angled edge 94A of the first end section 94 of the bottom first major flap 90. FIG. 3 is an inside view of the box 10 illustrating the bottom flaps 70, 80, 90 and 100 after the first and second end sections 94 and 104 have been joined to the first and second minor flaps 70 and 80 and the box 10 has been fully erected.

Figure 8:
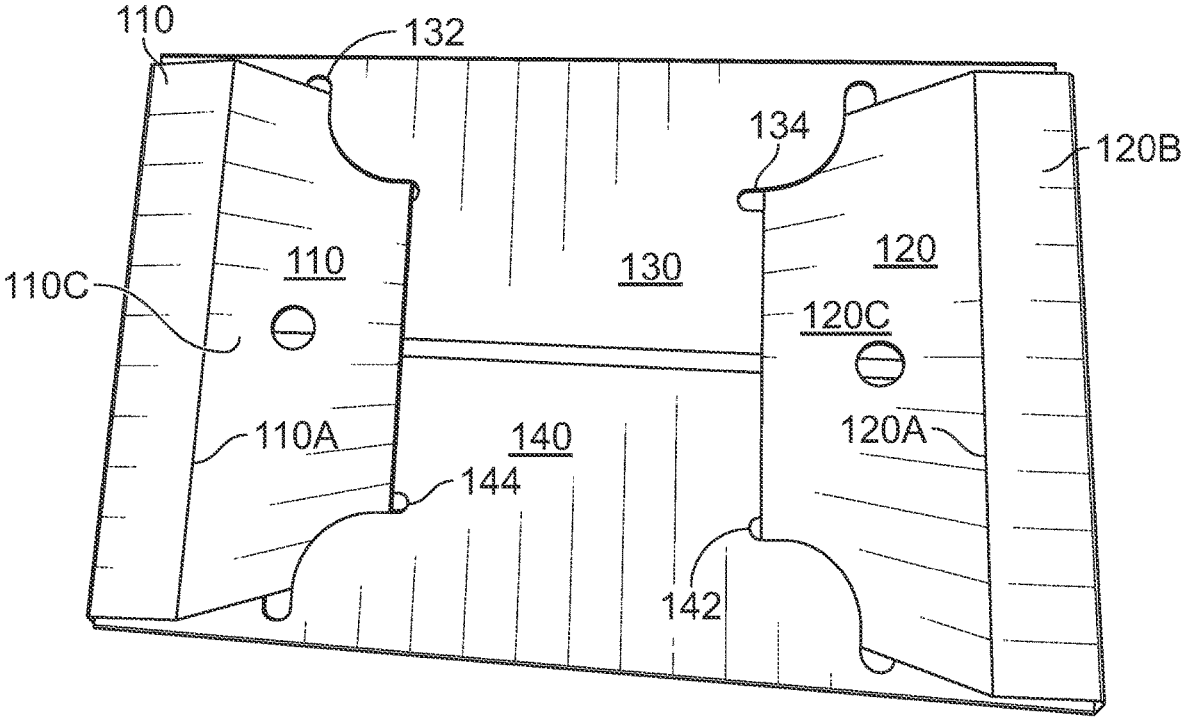
FIG. 8 is a top view of a erected box with the top minor and major flaps in a closed state.

Once product has been placed within the formed box 10, see the formed box 10 in FIGS. 1-3 without product, the top first and second major flaps 130 and 140 may be folded inward so as to be approximately 90 degrees to the front and back panels 30 and 40. Thereafter, the top first and second minor flaps 110 and 120 may be folded inward. With regards to the top first minor flap 110, the outer section 110C may be folded slightly with regard to the inner section 110B so that the first outer corner 112 may be inserted into the fourth opening 144 of the top second major flap 140 and the second outer corner 114 may be inserted into the first opening 132 of the top first major flap 130. With regards to the top second minor flap 120, the outer section 120C may be folded slightly with regard to the inner section 120B so that the third outer corner 122 may be inserted into the second opening 134 of the top first major flap 130 and the fourth outer corner 124 may be inserted into the first opening 142 of the top second major flap 140, see FIG. 8. The top first and second major flaps 130 and 140 and the first and second minor flaps 110 and 120 are maintained in a closed state when the corners 112, 114, 122 and 124 have been inserted into the openings 144, 132, 134 and 142.

Figure 9:
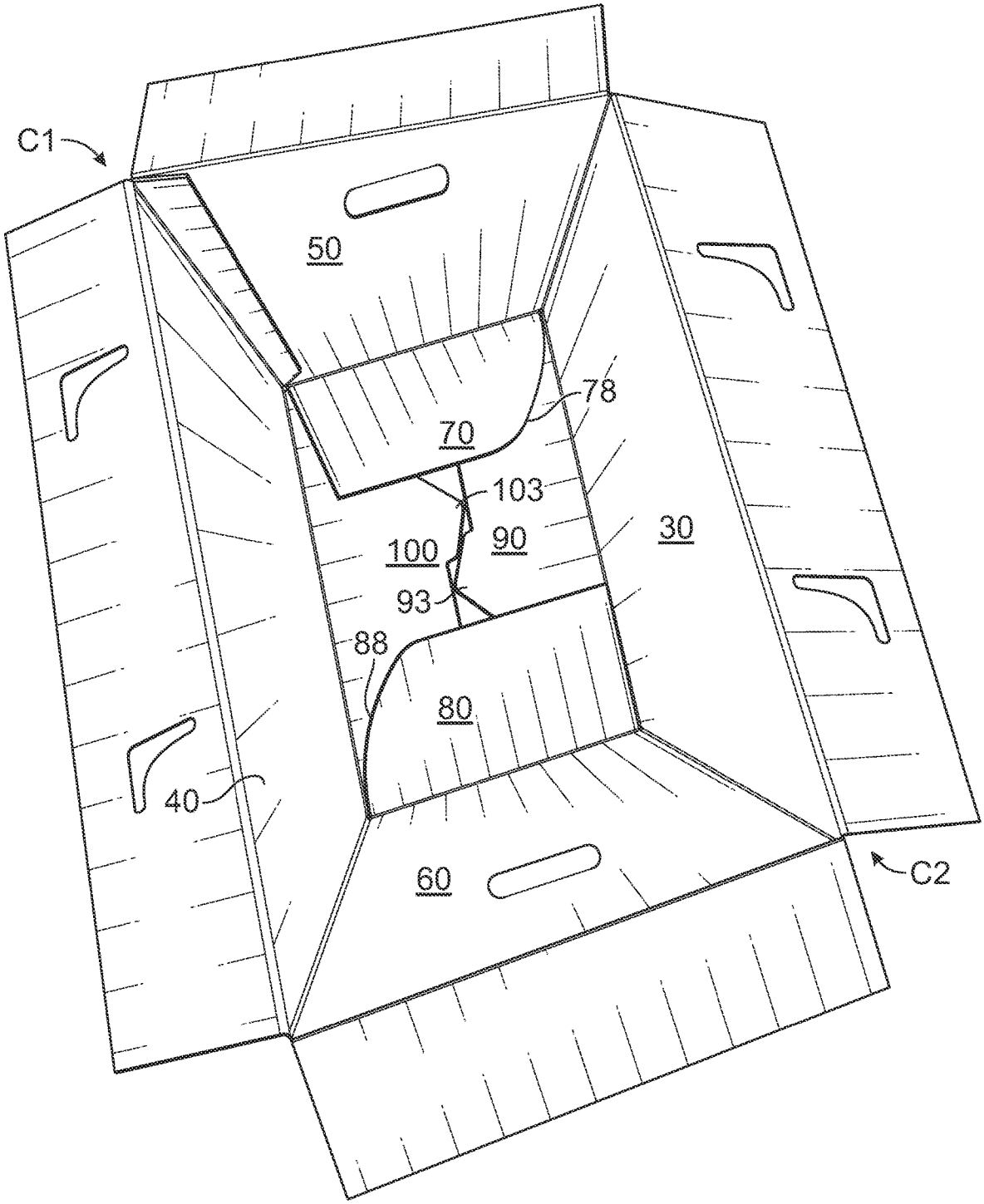
FIGS. 9 and 10 are interior views of an erected box as it is being collapsed.
Figure 10:
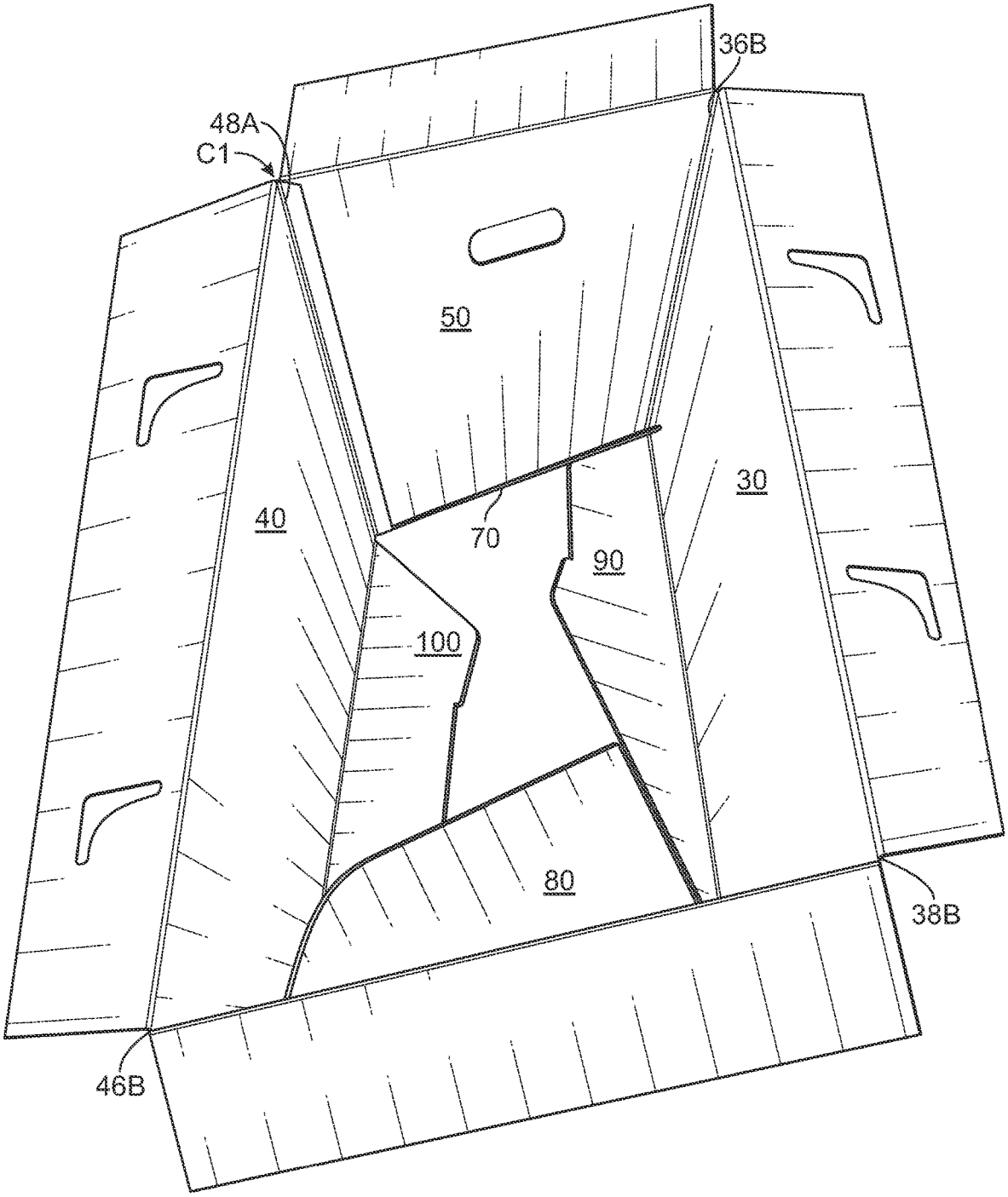
Figure 11:
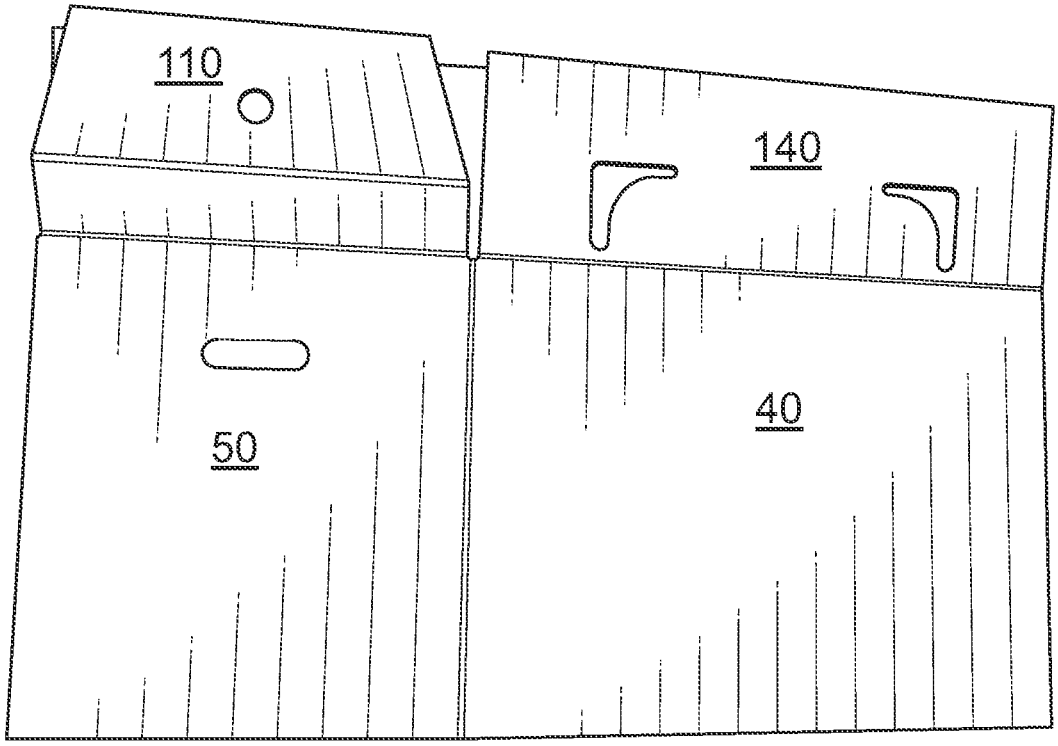
FIG. 11 is a view of the box of FIGS. 9 and 10 after it has been fully collapsed.

Once it is desired to remove product from the closed box and collapse the box for storage, the closed box 10 is opened by removing the outer corners 112, 114, 122, 124 of the top first and second minor flaps 110 and 120 from the openings 132, 134, 142, 144 in the top first and second major flaps 130 and 140 and moving or rotating the flaps 110, 120, 130 and 140, such as to the open position illustrated in FIG. 1. The product can then be removed from the opened box 10. Thereafter, a user may apply pressure to a first corner $C_1$ and a second corner $C_2$ concurrently, see FIGS. 1, 9 and 10, to cause the box 10 to collapse to a generally flat condition, see FIG. 11, for storage prior to reuse. The first corner $C_1$ may be located at an interface between or an intersection of the back panel 40 and the first side panel 50, while the second corner $C_2$ may be located at an interface between or an intersection of the front panel 30 and the second side panel 60, see FIG. 9. As the box 10 is collapsed, the first side panel 50 moves toward the front panel 30 and the second side panel 60 moves toward the back panel 40, see FIG. 10. During this movement to collapse the box 10, because the bottom first minor flap 70 has an arced or angled second longitudinal edge 78, the second longitudinal edge 78 does not engage with the front panel 30, or if it does engage with the front panel 30, it does not engage the front panel 30 to an extent that the bottom first minor flap 70 engages and binds with the front panel 30 to prevent the box from collapsing. Rather, the first minor flap 70 and the front panel 30 are able to move relative to one another to a flattened state and also when the box 10 is re-erected. Likewise, during this movement, because the bottom second minor flap 80 has an arced or angled second longitudinal edge 88, the second longitudinal edge 88 does not engage with the back panel 40, or if it does engage with the back panel 40, it does not engage the back panel 40 to an extent sufficiently that the bottom second minor flap 80 engages and binds with the back panel 40 to prevent the box from collapsing. Rather, the second minor flap 80 and the back panel 40 move relative to one another to a flattened state and also when the box 10 is re-erected. It is also noted that the first and second locking tabs 93 and 103 are angled such that they are able to move relative to one another when the box 10 is moving to its collapsed state or is being re-erected.

When the box 10 is fully erected, as illustrated in FIG. 3, the first angled tab edge 92D of the first locking tab 93 is generally parallel to the second angled tab edge 102D of the second locking tab 103 and both the first and the second tab edges 92D and 102D are generally parallel to a line L extending between third and fourth corners $C_3$ and $C_4$, wherein the third corner $C_3$ may be located at an interface between or an intersection of the front panel 30 and the first side panel 50, while the fourth corner $C_4$ may be located at an interface between or an intersection of the back panel 40 and the second side panel 60, see FIG. 3.

The first side panel 50 is hingedly connected to the longitudinal edge 36 of the front panel 30, such that the first side panel 50 and the front panel 30 are joined together at a first interface 36B. The first side panel 50 is also hingedly connected to the longitudinal edge 48 of the back panel 40 via the glue flap 49 such that the first side panel 50 and the back panel 40 meet at a second interface 48A. The second side panel 60 is hingedly connected to the longitudinal edge 38 of the front panel 30, such that the second side panel 60 and the front panel 30 are jointed together at a third interface 38B. The second side panel 60 is also hingedly connected to the longitudinal edge 46 of the back panel 40, such that the second side panel 60 and the back panel 40 are joined together at a fourth interface 46B. When the box 10 is collapsed, the second and third interfaces 48A and 38B are positioned intermediate the first and fourth interfaces 36B and 46B.

Hence, the container 10 of the present disclosure comprises: the first and second side panels 50 and 60, the front panel 30 and the back panel 40; and the bottom first and second minor flaps 70 and 80, where the bottom first minor flap 70 is coupled to the first side panel 50 along the lateral edge 54 of the first side panel 50, and the second minor flap 80 coupled to the second side panel 60 along the lateral edge 64 of the second side panel 60. The container may further comprise the first and second major flaps 90 and 100, where the first major flap 90 is coupled to the front panel 30 along the lateral edge 34 of the front panel 30, and the second major flap 100 is coupled to the back panel 40 along the lateral edge 44 of the back panel 40. The first major flap 90 may comprise the first locking tab 93 capable of engaging with the second major flap 100 when the container is erected and the second major flap 100 may comprise the second locking tab 103 capable of engaging with the first major flap 90 when the container is erected. The first and second minor flaps 70 and 80 and the first and second major flaps 90 and 100 may be folded inwardly along corresponding fold lines such that the first and second minor flaps 70 and 80 are located inwardly from the first and second major flaps 90 and 100, as illustrated in FIG. 3. That is, the bottom first and second minor flaps 70 and 80 are located closer to the top minor and major flaps 110, 120, 130 and 140 than the bottom major flaps 90 and 100 when the box 10 is erected and closed.

While particular embodiments of the present invention have been illustrated and described, it should be understood that various changes and modifications may be made without departing from the spirit and scope of the invention. It is therefore intended to cover in the appended claims all such changes and modifications that are within the scope of this invention.

The invention claimed is:

1. A container comprising:

first and second side panels, a front panel and a back panel;

first and second minor flaps, the first minor flap coupled to the first side panel along a lateral edge of the first side panel, and the second minor flap coupled to the second side panel along a lateral edge of the second side panel;

first and second major flaps, the first major flap coupled to the front panel along a lateral edge of the front panel, and the second major flap coupled to the back panel along a lateral edge of the back panel, the first major flap comprising a first locking tab capable of engaging with the second major flap when the container is erected and the second major flap comprising a second locking tab capable of engaging with the first major flap when the container is erected;

wherein the first and second minor flaps and the first and second major flaps are folded inwardly along corresponding fold lines such that the first and second minor flaps are located inwardly from the first and second major flaps;

wherein the first major flap comprises a first main section and a first end section, and the second major flap comprises a second main section and a second end section;

wherein when the container is erected, an entirety of the first end section is positioned on an outer surface of the first minor flap, and an entirety of the second end section is positioned on an outer surface of the second minor flap;

wherein the container, after initially being erected, is capable of being collapsed and re-erected;

wherein the first main section defines a first outer angled edge and the first end section defines a first inner angled edge, the second main section defines a second outer angled edge and the second end section defines a second inner angled edge, and wherein, when the container is fully erected, the first outer angled edge aligns with the second inner angled edge and the second outer angled edge aligns with the first inner angled edge; and wherein the first outer angled edge is generally parallel to the first inner angled edge and the second outer angled edge is generally parallel to the second inner angled edge.

2. A blank for constructing a container comprising:

a front panel having opposing lateral edges and opposing longitudinal edges;

a back panel having opposing lateral edges and opposing longitudinal edges;

a first side panel having opposing lateral edges and opposing longitudinal edges and hingedly connected to one of the longitudinal edges of the front panel;

a second side panel having opposing lateral edges and opposing longitudinal edges and hingedly connected to another one of the longitudinal edges of the front panel;

first and second minor flaps, the first minor flap coupled to the first side panel along one of the lateral edges of the first side panel, and the second minor flap coupled to the second side panel along one of the lateral edges of the second side panel;

first and second major flaps, the first major flap coupled to the front panel along one of the lateral edges of the front panel, and the second major flap coupled to the back panel along one of the lateral edges of the back panel, the first major flap comprising a first locking tab and the second major flap comprising a second locking tab; and wherein the first major flap comprises a first outer angled edge extending at an angle between 35 degrees and 55 degrees to the one lateral edge of the front panel, and the second major flap comprises a second outer angled edge extending at an angle between 35 degrees and 55 degrees to the one lateral edge of the back panel;

wherein the first major flap comprises a first main section and a first end section, the first main section comprising the first outer angled edge and the first end section defining a first inner angled edge;

wherein the second major flap comprises a second main section and a second end section, the second main section comprising the second outer angled edge and the second end section defining a second inner angled edge; and wherein the first outer angled edge is generally parallel to the first inner angled edge and the second outer angled edge is generally parallel to the second inner angled edge.

3. The blank of claim 2, wherein a first fold line extends between the first main section and the first end section and a second fold line extends between the second main section and the second end section.

4. The blank of claim 2, wherein the first end section defines a first end section outer angled edge that extends at an angle between 50 degrees to 90 degrees to the lateral edge of the front panel, and the second end section defines a second end section outer angled edge that extends at an angle of between 50 degrees and 90 degrees to the lateral edge of the back panel.

5. The blank of claim 2, wherein:

the first main section of the first major flap further comprises a first intermediate edge, a first step and a first angled tab edge, the first intermediate edge extending between the first inner angled edge of the first end section and the first step, the first step, the first angled tab edge and a portion of the first outer angled edge of the first main section defining the first locking tab; and the second main section of the second major flap further comprises a second intermediate edge, a second step and a second angled tab edge, the second intermediate edge extending between the second inner angled edge of the second end section and the second step, the second step, the second angled tab edge and a portion of the second outer angled edge of the second main section defining the second locking tab.

6. The blank of claim 2, wherein the first minor flap comprises first and second lateral edges and first and second longitudinal edges, the first minor flap is coupled to the first side panel at the first lateral edge of the first minor flap, the second lateral edge having a length less than a length of the first lateral edge, and the second longitudinal edge extending inwardly towards the first longitudinal edge as it extends from the first lateral edge to the second lateral edge; and the second minor flap comprises third and fourth lateral edges and third and fourth longitudinal edges, the second minor flap is coupled to the second side panel at the third lateral edge of the second minor flap, the fourth lateral edge having a length less than a length of the third lateral edge, the fourth longitudinal edge extending inwardly toward the third longitudinal edge as it extends from the third lateral edge to the fourth lateral edge.

* * * * *